US007992337B2

(12) United States Patent
Ochoa

(10) Patent No.: US 7,992,337 B2
(45) Date of Patent: Aug. 9, 2011

(54) METHOD AND APPARATUS TO MOUNT RECOIL DAMPENING APPARATUS ON RIFLE

(76) Inventor: Adam A. Ochoa, Scottsdale, AZ (US)

( * ) Notice: Subject to any disclaimer, the term of this patent is extended or adjusted under 35 U.S.C. 154(b) by 0 days.

(21) Appl. No.: 11/377,624

(22) Filed: Mar. 16, 2006

(65) Prior Publication Data

US 2007/0214697 A1 Sep. 20, 2007

(51) Int. Cl.
*F41C 23/00* (2006.01)

(52) U.S. Cl. ..... 42/74; 42/73; 42/75.03

(58) Field of Classification Search ..... 42/74, 71.01, 42/73, 75.03

See application file for complete search history.

(56) References Cited

U.S. PATENT DOCUMENTS

| | | | | |
|---|---|---|---|---|
| 1,379,989 | A * | 5/1921 | Johnson | 42/74 |
| 3,388,494 | A * | 6/1968 | Kimball | 42/74 |
| 5,031,348 | A * | 7/1991 | Carey | 42/74 |
| 5,410,833 | A * | 5/1995 | Paterson | 42/73 |
| 6,481,143 | B2 * | 11/2002 | McCarthy | 42/74 |
| 6,560,911 | B2 * | 5/2003 | Sharp | 42/73 |
| 6,874,267 | B2 * | 4/2005 | Fitzpatrick et al. | 42/72 |
| 7,024,812 | B2 * | 4/2006 | Nelson | 42/73 |
| 2004/0031182 | A1 * | 2/2004 | Bentley | 42/74 |

* cited by examiner

*Primary Examiner* — J. Woodrow Eldred
*Assistant Examiner* — Gabriel J Klein
(74) *Attorney, Agent, or Firm* — Tod R. Nissle, P.C.

(57) ABSTRACT

A method and apparatus are provided to mounted recoil dampening apparatus on a rifle at a selected slope, cant, length, and stowed position.

3 Claims, 4 Drawing Sheets

METHOD AND APPARATUS TO MOUNT RECOIL DAMPENING APPARATUS ON RIFLE

This invention pertains to a method and apparatus to dampen the recoil of a rifle.

More particularly, this invention pertains to recoil dampening apparatus that permits the cant, slope, length, and lateral position of the recoil apparatus to be adjusted to facilitate use of the recoil apparatus in conjunction with a rifle.

Systems for absorbing the recoil of a rifle are known. Such systems typically comprise a spring system mounted in the stock of the rifle. While such systems do absorb some of the energy produced during the discharge of a rifle, they typically are constructed for integration with the existing stock of a rifle or are utilized in set configurations that do not permit ready adaptation of the systems to different rifle designs and to individuals of differing physical stature.

Accordingly, it would be highly desirable to provide an improved method and apparatus for equipping a rifle with recoil dampening apparatus.

Therefore, it is a principal object of the instant invention to provide an improved method and apparatus for equipping different rifle designs with a recoil dampening system.

A further object of the invention is to provide a rifle recoil dampening method and apparatus that facilitates the use of a rifle by individuals of differing stature.

These and other, further and more specific objects and advantages of the invention will be apparent from the following detailed description of the invention, taken in conjunction with the drawings, in which.

Briefly, in accordance with my invention, I provide an improved method to mount recoil dampening apparatus on a rifle. The rifle includes a stock. The method comprises the steps of providing an adaptor to be mounted on the rifle after the stock is removed; and, providing a recoil dampening unit including a shoulder butt, a cheek weld, and an end to be mounted on the adaptor. The unit includes apparatus to adjust the length of the unit, and apparatus to permit the end and the rifle to recoil and move toward the butt when the rifle is discharged. The end and adaptor are shaped and dimensioned to permit the cant of the unit to be rotationally adjusted, and to mount the unit on the rifle at a selected slope with respect to the rifle to facilitate positioning of the shoulder butt against a user's shoulder. The method also includes the steps of removing the stock from the rifle; mounting the adaptor on the rifle; inserting the end in the adaptor to mount the unit at the selected slope; rotationally adjusting the cant of the unit; adjusting the length of the unit; and, fixedly securing the end in the adaptor. The adaptor can include interconnecting apparatus that permits the unit to move pivotally between at least two operative positions, a first operative position with said unit in alignment with the rifle, and a second operative position with said unit laterally displaced from said first operative position to a location adjacent the rifle. The interconnecting apparatus includes a displaceable release pin, and an arcuate opening engageable and disengageable by the release pin.

In another embodiment of the invention, I provide in improved method of method of mounting recoil dampening apparatus on a rifle. The rifle includes a stock. The method includes the steps of providing an adaptor to be mounted on the rifle after the stock is removed; and, providing a recoil dampening unit including a shoulder butt, a cheek weld, and an end. The recoil dampening unit includes apparatus to permit the end and the rifle to recoil and move toward the butt when the rifle is discharged. The method also includes the step of connecting the adaptor and dampening unit with interconnecting apparatus to permit the unit to move pivotally between at least two operative positions, a first operative position with said unit in alignment with the rifle, and a second operative position with the unit laterally displaced from the first operative position and adjacent the rifle. The interconnecting apparatus includes a displaceable release pin, and an arcuate opening engageable and disengageable by the release pin. The method also includes the steps of removing the stock from the rifle; and, mounting the adaptor on the rifle.

Figure 1:
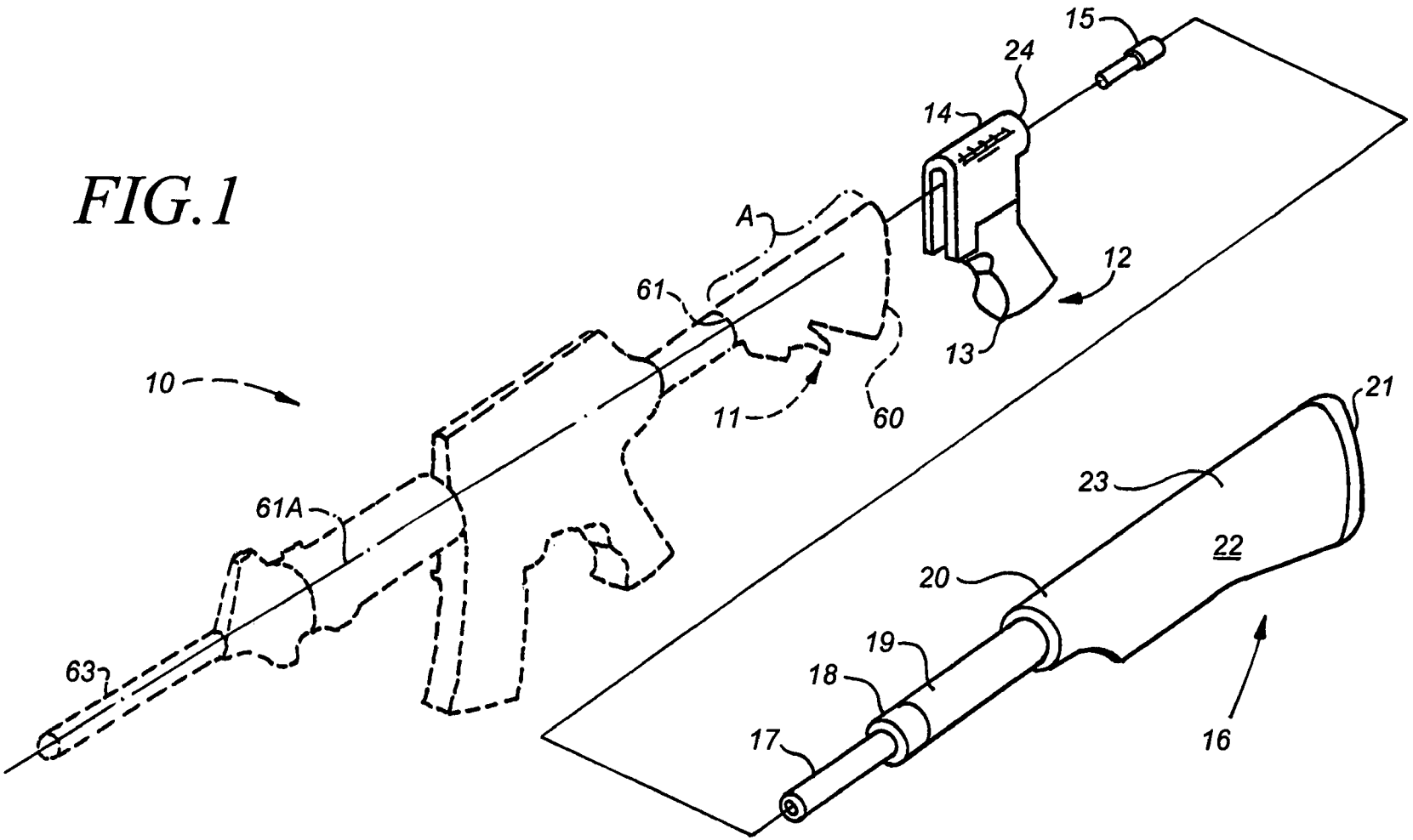
FIG. 1 is an exploded assembly view illustrating a rifle recoil dampening apparatus constructed in accordance with the principles of the invention.

Turning now to the drawings, which depict the presently preferred embodiments of the invention for the purpose of illustrating the practice thereof and not byway of limitation of the scope of the invention, and in which like reference characters refer to corresponding elements throughout the several views, FIG. 1 illustrates in ghost outline 10 a M16 rifle including a stock 11. The length of stock 11 is indicated by bracket A. As used herein, rifles include weapons having a rifled bore and intended to be shot from the shoulder, and also include shotguns. Adaptor 12 is configured to be attached to the end 60 of stock 11, or, when stock 11 is removed from rifle 10, to be attached to exposed end 61 of rifle 10.

Adaptor 12 includes hollow adjustment ring 24 fixedly or removably secured to upper portion 14. Externally threaded fastener 15 is inserted through an opening (not visible) formed in upper portion 14 and is turned into an internally threaded opening (not visible) formed in end 60 or 61 to secure adaptor 12 to rifle 10. Any desired apparatus or means can be utilized to secure adaptor 12 to rifle 10. Adaptor 12 can be permanently secured to rifle 10, but normally is removably secured to rifle 10. A handle 13 can, but need not, be attached to upper portion 14.

Figure 2:
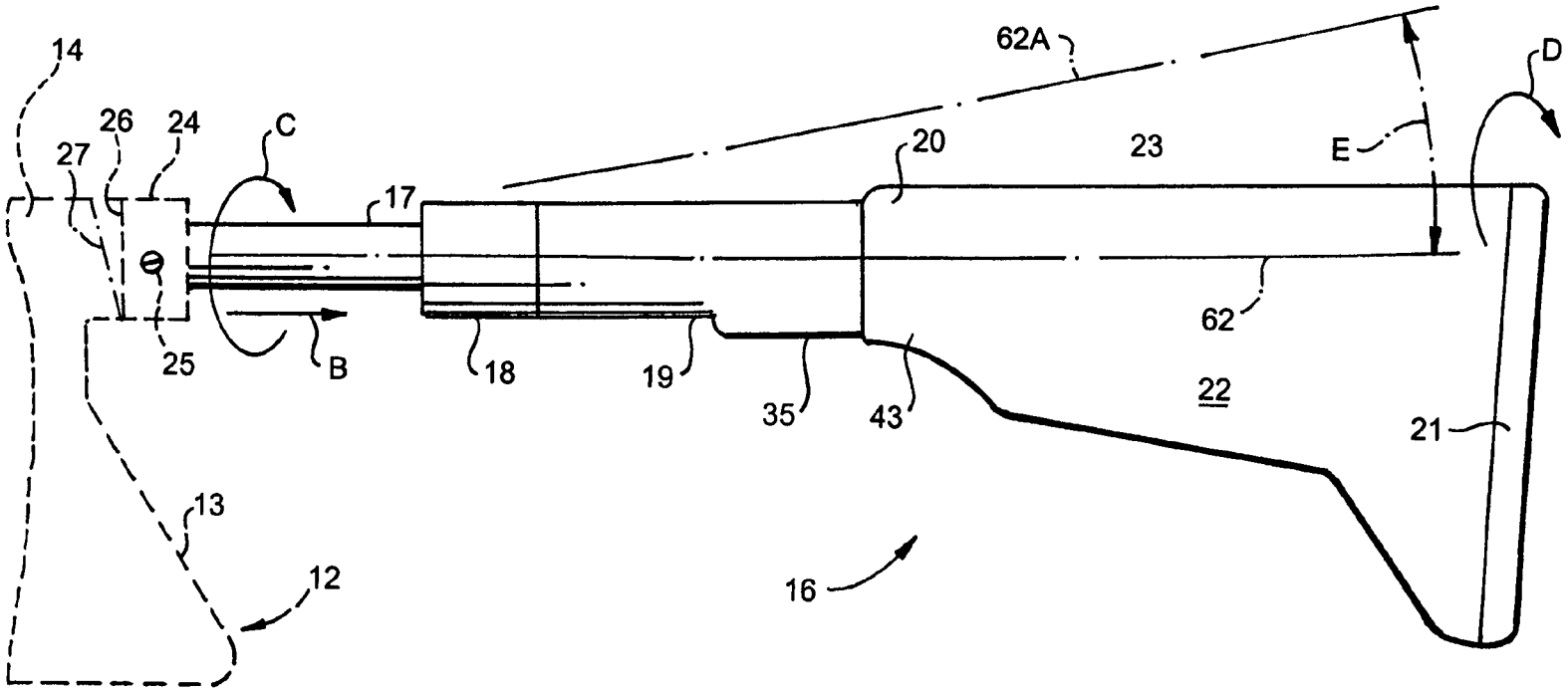
FIG. 2 is a side elevation view illustrating the mode of operation of the rifle recoil dampening apparatus of the invention.
Figure 2A:
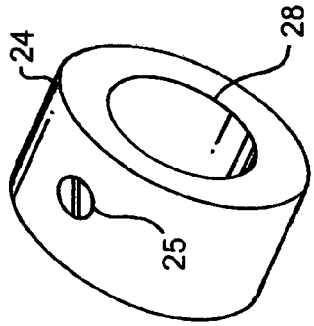
FIG. 2A is a perspective view illustrating an adjustment ring utilized in the apparatus of FIG. 2.

As is illustrated in FIG. 2A, adjustment ring 24 includes hollow cylindrical opening 28 and set screw(s) 25. Opening 28 is sized to receive slidably the cylindrical end of recoil dampening apparatus 16. In FIG. 2A, adjustment ring 24 is cylindrically shaped. However, as indicated by dashed line 27, ring 24 can be wedge shaped and/or the surface 26 of portion 14 against which ring 24 rests can be canted such that the slope of unit 16 will be in a desired orientation. In FIG. 2, the longitudinal axis 62 of unit 16 is co-linear with the centerline of cylindrical end 17. Axis 62 is also co-linear with the longitudinal axis 61A (FIG. 1) of rifle 10. Axis 61A is co-linear with the centerline of the muzzle 63 of rifle 10. The slope of axis 62 in FIG. 2 is zero. Axis 62 need not be co-linear with axis 61A, and the slope of axis 62 need not be zero. Unit 16 and its longitudinal axis 62 can instead slope upwardly, as illustrated by dashed line 62A, a selected angle E from the horizontal, or, unit 16 and its longitudinal axis 62 can instead slope downwardly a selected angle from the horizontal. When cylindrical end 17 is slidably inserted in ring 24, the centerline of end 17 is co-linear with the centerline of ring 24.

Therefore, appropriately adjusting the shape of ring 24 or the orientation of surface 26 can adjust the slope of unit 16. If desired, wedge shaped spacers can also be utilized intermediate ring 24 and surface 26 to alter the orientation of ring 24 and adjust the slope of unit 16.

Another advantage of adjustment ring 24 is that cylindrical end 17 can be rotated in ring 24 in the manner indicated by arrow C to adjust, in the manner indicated by arrow D, the cant of unit 16 and of the butt 21 of unit 16. This, along with choosing a selected slope for unit 16, permits a user to adjust the cant of unit 16 so that butt 21 most comfortably conforms to the user's shoulder. Once end 17 and unit 16 have been rotated to a selected cant, set screw 25 is tightened to secure end 17 in adjustment ring 24.

Figure 3:
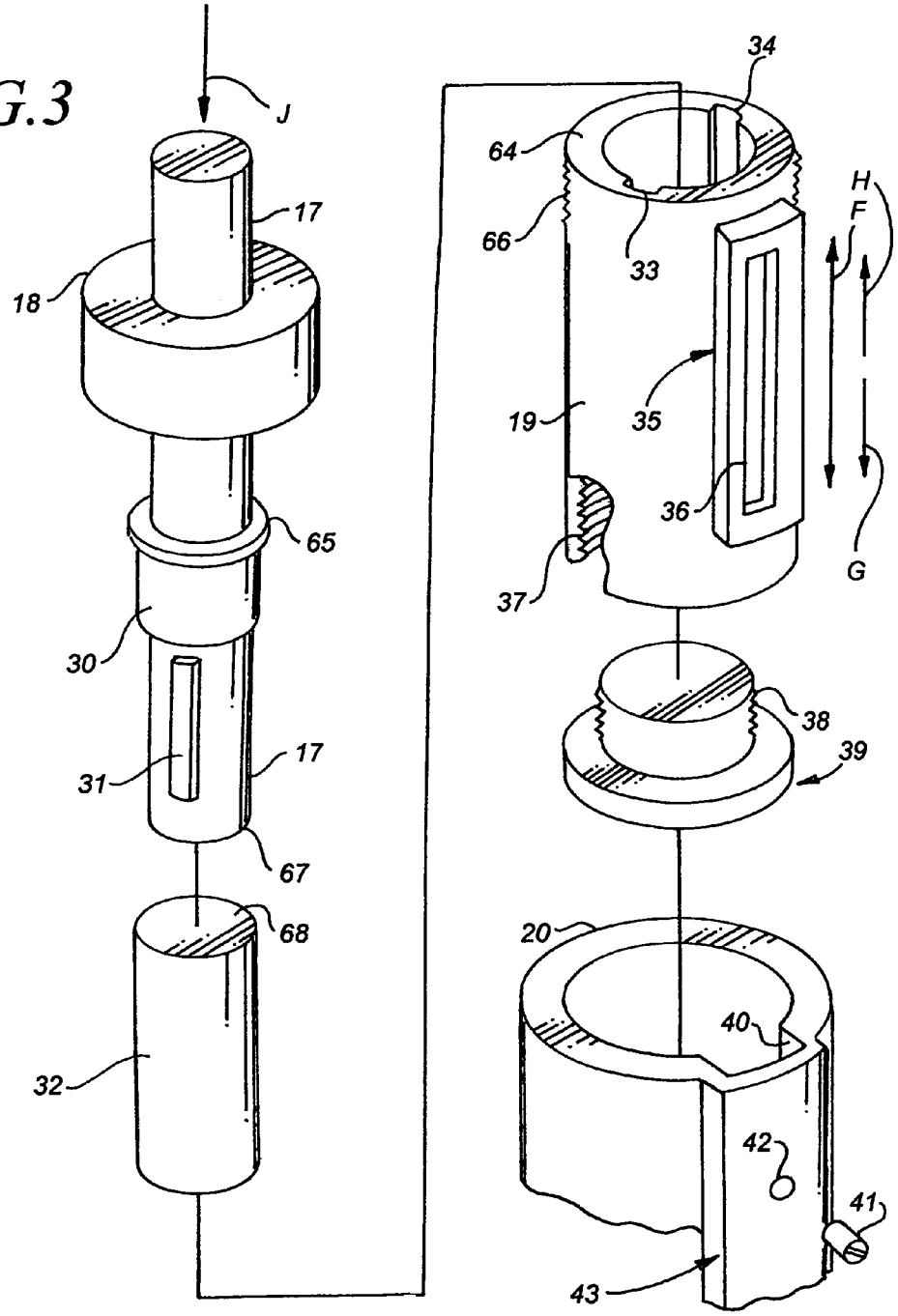
FIG. 3 is an exploded assembly perspective view illustrating the construction of the apparatus of FIG. 2.

As is illustrated in FIG. 3, cylindrical end 17 includes a pair of elongate orthogonal keys 31 each slidably received by one of slots 33, 34 formed in elongate hollow generally cylindrical adjustment member 19. Member 19 is slidably received by hollow cylindrical end 20 of the auxiliary stock 23 that comprises a portion of unit 16. Member 19 includes key 35 with elongate slot 36 formed therein. Slot 36 has a length indicated by arrows F. Key 35 is slidably received by slot 40 formed in rib 43 of end 20. After member 19 is slidably adjusted in the directions indicated by arrows G and H, set screw 41 is turned through internally threaded aperture 42 in rib 43 and into slot 36 to secure member 19 in a selected position in end 20. Slidably adjusting in the directions of arrows G and H member 19 permits the length of unit 16 to be adjusted. Member 19 and end 20 preferably are shaped and dimensioned such that the length of unit 16 can, by moving member 19 in end 20, be adjusted by at least nine inches so that the length of unit 16 can be adjusted for both men and women.

Externally threaded end 38 of plug 39 is turned into internally threaded end 37 of member 19. Polyurethane member 32 or a spring or some other compressible resilient member is slidably inserted in member 19 and seats against end 38. End 17 is inserted in member 19 by sliding keys 31 into slots 33, 34. Polymer sleeve 30 slides along end 17 and into member 19 until lip 65 seats against flat, circular lip 64 of member 19. Internally threaded cap 18 turns onto the externally threaded end 66 of member 19. Sleeve 30 secures keys 31 in member 19 and, consequently, prevents keys 31 and the portion of end 17 in member 19 from sliding outwardly from within member 19. When, however, a rifle is discharged and a recoil force J (FIG. 3) is generated against end 17, end 17 can slidably move in member 19 in a direction indicated by arrow G such that bottom 67 contacts end 68 of member 32 and compresses resilient member 32 against end 38 of plug 39.

Figure 5:
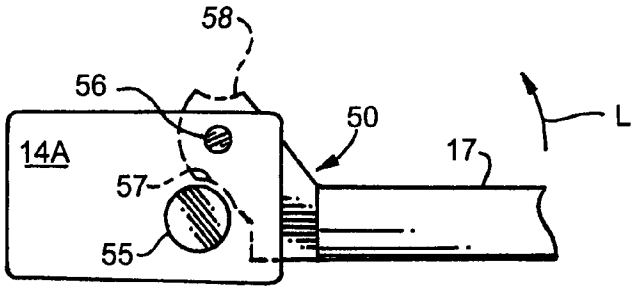
FIG. 5 is a top view of the apparatus of FIG. 4 illustrating the mode of operation thereof; and, FIG. 6 is a top view of the apparatus of FIG. 4 further illustrating the mode of operation thereof.
Figure 6:
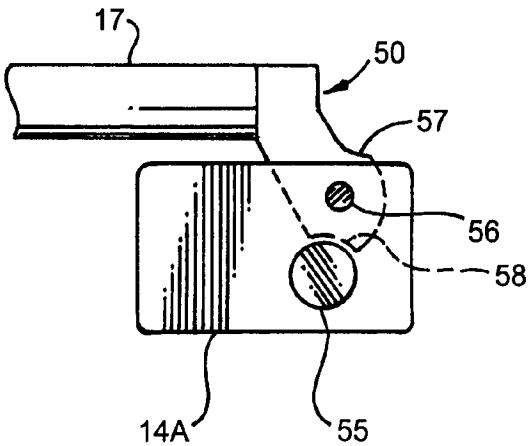
Figure 4:
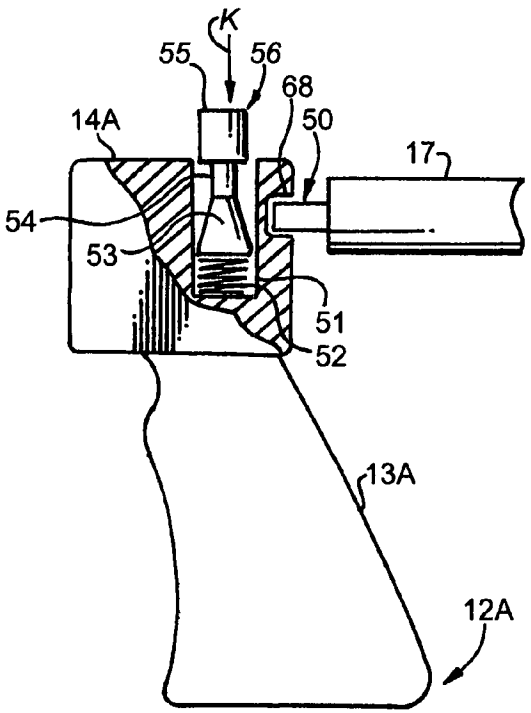
FIG. 4 is a side view illustrating an alternate embodiment of the recoil dampening apparatus of the invention.

An alternate embodiment of the invention is illustrated in FIGS. 4 to 6 and includes an adaptor 12A having a handle 13A and an upper portion 14A. Portion 14A is configured to be attached to either the stock 11 or to a rifle end 61 that is exposed when stock 11 is removed. Spring 52 is seated in opening 51 formed in portion 14A. Pin 56 includes cylindrical neck 54 and conical end 53. When spring 51 is in the expanded position illustrated in FIG. 4, conical end 53 is seated against a notch 58 or 57 formed in arm 50. Arm 50 will not pivot about pin 56 when end 53 is seated against a notch 58 or 57. When head 55 of pin 56 is downwardly depressed in the direction of arrow K, conical end 53 disengages from a notch 57 or 58, cylindrical neck 54 moves adjacent—but spaced apart from—notch 57 or 58, and arm 50 is free to pivot about pin 56. Arm 50 is fixedly connected to end 17.

When arm 17 is in the position illustrated in FIG. 5, unit 16 is in the first deployed operative position illustrated in FIGS. 1 and 2 with the longitudinal axis 62 of unit 16 co-linear with the longitudinal axis 61A of rifle 10. When arm 17 is in the second stowed operative position illustrated in FIG. 6, unit 16 extends from adaptor 12A alongside rifle 10 toward muzzle 63, typically with auxiliary stock 22 near or adjacent the muzzle 63 of rifle 10. Arm 17 is moved from the first deployed operative position of FIG. 5 to the second stowed operative position of FIG. 6 by depressing head 55 to disengage conical end 53 from notch 57; by pivoting end 17 and unit 16 about pin 56 in the direction of arrow L to the position illustrated in FIG. 6; and, by releasing head 55 such that compressed spring 52 expands and moves conical end 53 into engagement with notch 58 to fix arm 50 and unit 16 in place. Arm 50 extends into a groove 68 formed in upper portion 14A.

In FIGS. 5 and 6 only end 17 of unit 16 is, for sake of simplicity, illustrated.

In use, the adaptor 12 and unit 16 of FIG. 1 are provided. Ring 24 is configured, upper portion 14 is configured, and/or shims or other apparatus are utilized to position ring 24 on adaptor 12 such that the slope of unit 16 will have the desired value to orient unit 16 in the desired position with respect to rifle 10. Ring 24 is positioned on and affixed to adaptor 12.

Stock 11 is removed from rifle 10.

Fastener 15 is threaded through adaptor 12 and into end 61 of rifle 10 to secure adaptor 12 to rifle 10.

End 17 is slidably inserted into adjustment ring 24.

Unit 16, and consequently end 17, are rotated C, D until the desired cant of unit 16 is achieved. Set screw 25 is turned into upper portion 14 to tighten end 17 in position.

Member 20 is slidably moved along member 19 to adjust the length of unit 16 to a desired value. Set screw 41 is turned into aperture 42 and into slot 36 to secure end 20, comb 23, face meld 22, and butt 21 in fixed position. Unit 16 and rifle 10 are ready for use.

I claim:

1. A method of mounting recoil dampening apparatus on a rifle including a stock comprising the steps of (a) providing an adaptor (24) to be mounted on the rifle after the stock is removed, said adaptor having a cylinder bore therein (b) providing a recoil dampening unit including (i) a shoulder butt (21)

(ii) a slidably displaceable member with a first end to be slidably and rotatably mounted on said adaptor such that said first end is mounted within said cylindrical bore of said adaptor, and a second end (67), (iii) apparatus to adjust the length of said unit, and (iv) apparatus to permit said slidably dispaceable member and the rifle to recoil and move toward and relative to said butt when the rifle is discharged and including a base (20), a stop (39) with contact surface (38), a housing (19) mounted in said base (20) and including a hollow bore extending therethrough, said second end (67) slidably extending into said hollow bore, at least one resilient member (32) in said hollow bore inside said housing and including a primary end contacting said contact surface (38), and a secondary end (68) directly contacting said second end (67) of said slidably displaceable member such that said slidably displaceable member compresses said resilient member (32) against said contact surface (38)during the recoil of the rifle, said first end and said adaptor shaped and dimensioned to (v) permit the cant of said unit to be rotationally slidably adjusted to at least
a first selected cant, and
a second selected cant less than ninety degrees from said first selected cant,
(vi) mount said unit on the rifle at at least
a first selected slope, and
a second selected slope different from said first slope with respect to the rifle to facilitate positioning of the shoulder butt against a user's shoulder;
(c) removing the stock from the rifle;
(d) mounting said adaptor on the rifle;
(e) inserting said first end of said slidably displaceable member in said adaptor to mount said unit at one of said first and second selected slopes;
(f) rotationally adjusting the cant of said unit to one of said first and second selected cants;
(g) adjusting the length of said unit; and,
(h) fixedly securing said first end on said adaptor.

2. A method of mounting recoil dampening apparatus on a rifle including a stock comprising the steps of
(a) providing an adaptor (24) to be mounted on the rifle after the stock is removed, said adapter having a cylindrical bore therein;
(b) providing a recoil dampening unit including
(i) a shoulder butt (21)
(ii) a slidably displaceable member with
a first end to be slidably and rotatably mounted on said adapter such that said first end is mounted within said cylindrical bore of said adaptor, and
a second end (67)
(iii) apparatus to adjust the length of said unit, and
(iv) apparatus to permit said slidably displaceable member and rifle to recoil and move toward and relative to said butt when the rifle is discharged and including
a base (20),
a stop (39) with contact surface (38),
a housing (19) mounted in said base (20) and including a hollow bore extending therethrough, said second end (67) slidably extending into said hollow bore,
at least one resilient member (32) in said hollow bore inside said housing and including
a primary end contacting said contact surface (38), and
a secondary end directly contacting said second end (67) of said sidably displaceable member such that said slidably displaceable member compresses said resilient member (32) against said contact surface (38) during the recoil of the rifle,
said first end and said adaptor shaped and dimensioned to
(v) permit the cant of said unit to be rotationally slidably adjusted to at least
a first selected cant, and
a second selected cant less than ninety degrees from said first selected cant,
(vi) mount said unit on the rifle at at least a first selected slope, with respect to the rifle to facilitate positioning of the shoulder butt against a user's shoulder;
(c) removing the stock from the rifle;
(d) mounting said adaptor in the rifle;
(e) inserting said first end of said slidably displaceable member in said adaptor to mount said unit at said first selected slope;
(f) rotationally adjusting the cant of said unit to one of said first and second selected cants;
(g) adjusting the length of said unit; and,
(h) fixedly securing said end on said adaptor.

3. A method of mounting recoil dampening apparatus on a rifle including a stock comprising the steps of
(a) providing an adaptor (24) to be mounted on the rifle after the stock is removed, said adaptor having a cylindrical bore therein;
(b) providing a recoil dampening unit including
(i) a shoulder butt (21)
(ii) a slidably displaceable member with
a first end to be slidably and rotatably mounted said adaptor such that said first end is mounted within said cylindrical bore of said adaptor,
a second end (67),
(iii) apparatus to adjust the length of said unit, and
(iv) apparatus to permit said slidably displaceable member and the rifle to recoil and move toward toward and relative to said butt when the rifle is discharged and including
a base (20)
a stop (39) with contact surface (38),
a housing (19) slidably mounted in said base (20) and including a slot (35) and a hollow bore extending therethrough , said second end (67) of said slidably displaceable member slidably extending into said hollow bore,
at least one resilient member (32) in said hollow bore inside said housing and including
a primary end contacting said contact surface (38),
a secondary end (68) directly contacting said second end (67) of said slidably displaceable member such that said slidably displaceable member compresses said resilient member (32) against said contact surface (38) during the recoil of the rifle, and
a set screw (42) mounted in said base (20) and moveable between at least two operative positions,
a first operative position engaging said slot (35) to prevent the movement of said housing (19) in said base, and
a second operative position not engaging said slot (35) to permit the sliding movement of said housing (19) in said base (20) to adjust the length of said recoil dampening unit,
said first end and said adaptor shaped and diminished to
(v) permit the cant of said unit to be rotationally slidably adjusted to at least
a first selected cant, and
a second selected cant less than ninety degrees from said first selected cant,
(vi) mount said unit on the rifle at at least a first selected slope, with respect to the rifle to facilitate positioning of the shoulder butt against a user's shoulder;
(c) removing the stock from the rifle;
(d) mounting said adaptor on the rifle;
(e) inserting said first end of said displaceable member in said adaptor to mount said unit at said first selected slope;
(f) rotationally adjusting the cant of said unit to one of said first and second selected cants;
(g) adjusting the length of said unit; and,
(h) fixedly securing said first end on said adaptor.

* * * * *